United States Patent [19]

Baxter et al.

[11] 3,960,206

[45] June 1, 1976

[54] REFRIGERATED HOPPER EQUIPMENT FOR AUTOMATIC RIVETING MACHINES

[75] Inventors: George I. Baxter; Clarence P. Rolla, both of San Diego; Charles L. Holland, Escondido, all of Calif.

[73] Assignee: General Dynamics Corporation, San Diego, Calif.

[22] Filed: Jan. 2, 1975

[21] Appl. No.: 538,058

Related U.S. Application Data

[60] Continuation of Ser. No. 461,827, April 18, 1974, which is a division of Ser. No. 277,438, Aug. 2, 1972, Pat. No. 3,837,176.

[52] U.S. Cl. ..... 165/61; 62/514 R; 221/150 HC; 165/47

[51] Int. Cl.[2] ..... F25B 29/00

[58] Field of Search ..... 221/150 HC, 150 B; 165/26, 27, 61, 62; 62/225, 514

[56] References Cited

UNITED STATES PATENTS

| | | | |
|---|---|---|---|
| 2,851,324 | 9/1958 | Wellekens | 221/150 HC X |
| 3,293,877 | 12/1966 | Barnes | 62/514 X |
| 3,305,000 | 2/1967 | Bullen et al. | 62/514 R X |
| 3,611,738 | 10/1971 | Maurer et al. | 62/514 R X |
| 3,815,377 | 6/1974 | Tyree, Jr. | 62/514 X |

*Primary Examiner*—Albert W. Davis, Jr.
*Assistant Examiner*—James D. Liles
*Attorney, Agent, or Firm*—John R. Duncan

[57] ABSTRACT

A refrigerating apparatus enclosing the rivet hoppers of an automatic riveting machine. A refrigerant such as liquid nitrogen is conducted into the refrigerant coils of an insulated enclosure to maintain the temperature of the rivets in the hoppers at sub-zero temperature in order to retard the age hardening process. Frost formation on the rivets is effectively prevented by purging the enclosure with gaseous nitrogen. Upon passing through the coolant coils, the nitrogen absorbs sufficient heat to convert it from the liquid state to a gaseous state. The gas then discharges from the open end of the coils into the enclosure and through a vent in the side wall of the enclosure to atmosphere. To augment frost prevention, dry nitrogen gas is utilized to propel the rivets from the hoppers into the fingers of the riveting machine. Down time for servicing, changing rivets, etc. is reduced to a minimum by a temperature controlled space heater mounted inside the enclosure.

3 Claims, 3 Drawing Figures

REFRIGERATED HOPPER EQUIPMENT FOR AUTOMATIC RIVETING MACHINES

CROSS-REFERENCE TO RELATED APPLICATION

This application is a continuation of U.S. Pat. application Ser. No. 461,827, filed Apr. 18, 1974, which is a division of U.S. Pat. application Ser. No. 277,438, filed Aug. 2, 1972, which is now U.S. Pat. No. 3,837,176 granted Sept. 24, 1974.

BACKGROUND OF THE INVENTION

Riveted structures such as the wing panels and body panels of an airplane are frequently assembled with structural members tack riveted to skins for subsequent production riveting on an automatic riveting machine. In keeping with high strength-to-weight construction, the skins and structural members, viz, stringers, ribs, frames, etc. are usually of an aluminum alloy material secured together with aluminum alloy rivets. The rivets used for this purpose are generally of two alloy types designated and known commercially as 2117S or 2024S. Of these, 2024S rivets are preferred for their superior physical properties, which after heat treatment and age hardening, develop physical properties somewhat in excess of the properties of low carbon steel. The heat treatment for 2024S material is accomplished in the conventional manner as for other metals, i.e., the material is heated to a certain temperature and thereafter rapidly cooled by quenching in water. The 2024S material is soft after quenching but attains 90% of its maximum hardness and strength after aging for 24 hours at room temperature, and full strength after 4 to 6 days. This age hardening is very rapid in the first 4 hours after quenching, necessitating storage at very low temperatures to retard or delay the age hardening process until such time as the rivets are to be used. After approximately 20 minutes exposure at room temperature, the 2024S rivets attain a degree of hardness sufficient to prohibit their being used without danger of shearing or developing cracks.

In the handling of 2024S rivets, refrigerated containers are usually placed in convenient location within close proximity to the work area where they are needed. Rivets are quick frozen immediately following their fabrication and transported in insulated containers to the refrigerators for storage until such time as they are to be used. Workmen subsequently withdraw the frozen rivets in limited quentities to conserve supplied and avoid undue scrappage as a result of premature age hardening at room temperature.

Aircraft structures such as wing and fuselage panels, are frequently assembled with 2024S rivets in order to accommodate the load requirements of a particular design. The panels are usually hand riveted by the well-known rivet gun/bucking bar method, or wherever the design permits, by hand operated rivet squeezers. Hand riveting is obviously expensive and slow as compared to riveting done on automatic riveting machinery. However, presently available automatic riveting machines are not equipped to handle the 2024S type or "ice box" rivets.

The automatic riveting machines of the type employed by the aerospace industry are equipped with a plurality of motor driven hoppers in which a supply of rivets is contained subject to being dispensed by associated dispensing mechanism in individual units. Each hopper may contain a particular diameter and length rivet as required to secure the individual components of a workpiece together. The present invention adapts these automatic riveting machines for use with ice box or 2024S rivets. As presently constructed, i.e., without benefit of refrigeration or moisture inhibitors, rivets contained in the rivet hoppers would instantly freeze into clusters or agglomerates upon exposure to atmospheric humidity to thereby render the hopper's dispensing mechanism completely inoperative.

SUMMARY OF THE INVENTION

The automatic riveting machine of the present invention is provided with a refrigeration system by which the machine's hoppers and dispensing mechanism are refrigerated and maintained frost free. The refrigeration system includes an insulated box mounted in a convenient location on the frame of the riveting machine. A refrigerant such as liquid nitrogen ($LN_2$) is conducted into coils lining the interior of the box. Liquid nitrogen is conducted to the coils from a supply tank via conduits and through a normally closed solenoid actuated valve. The $LN_2$, upon circulating through the coils, changes from liquid to gaseous state, discharging into the box from an open end of the coils. An opening provided in the wall of the box vents the spent gaseous nitrogen ($GN_2$) to atmosphere.

In addition to being refrigerated, the box must further be maintained moisture free. This is accomplished by conducting moisture inhibiting gas such as $GN_2$ from a pressurized supply tank through a conduit and a normally open solenoid actuated valve into the interior of the box.

Operation of the solenoid actuated $LN_2$ and $GN_2$ line valves is controlled by a normally closed temperature controller and an associated sensor. In its closed position, the temperature controller bridges the circuit from a three position switch to the solenoids of the $LN_2$ and $GN_2$ line valves. With the switch in "cold" position the circuit is energized, opening the $LN_2$ valve and closing the $GN_2$ valve. Thus the $LN_2$ flows from the supply tank, through the $LN_2$ line, through the open $LN_2$ valve and into the coils to refrigerate the box. At such time as the temperature within the box is reduced to approximately −10°F, the sensor activates the temperature controller to open the circuit from the switch to the $LN_2$ and $GN_2$ valves. With the solenoids of the $LN_2$ and $GN_2$ valves de-energized, $GN_2$ flows into the refrigerated box from the supply tank, through the $GN_2$ line and the normally open $GN_2$ line valve. The $LN_2$ valve closes upon de-energization of its solenoid cutting off the supply of $LN_2$ into the refrigeration coils. The temperature controller is preferably programmed to operate within a temperature range from −10°F to −5°F. Thus, when the temperature of the box rises to −5°F, the circuit to the $LN_2$ and $GN_2$ valves is again closed, cutting off the $GN_2$ supply and simultaneously re-activating the $LN_2$ system to supply $LN_2$ into the refrigeration coils. The cycle is repeated as the temperature within the box is reduced to −10°F.

The "off" position of the switch is utilized when the riveting machine is inactivated or during times when the machine is operating with other than the ice-box type rivets, such as the 2117S rivets previously discussed.

The refrigerator box is provided with a hinged cover for servicing purposes. Ordinarily the supply of rivets to the hoppers within the box is replenished through a plurality of tapered openings in the cover in alignment with the chutes of the individual hoppers. Plugs or inserts serve to close the tapered openings after replenishing the rivet supply. Rivets are customarily stored under regrigeration in sealed containers which are opened immediately prior to their being poured through the tapered openings into the hoppers.

When it is desired to open the box cover, such as during servicing operations (changing rivets in the hoppers, making adjustments and repairs, etc.), the switch is shifted to its "hot" position whereby the circuit to a fan and heater mounted inside the box is activated. The heater circuit is bridged by a normally closed temperature controller actuated by a sensor located within the refrigerator box. A normally closed heater relay in circuit between the heater and switch remains closed until the temperature inside the box is elevated to a comfortable level for the workman performing the servicing operation. It will be noted that $GN_2$ is permitted to flow continuously during the heating cycle while the box cover is closed due to the $GN_2$ valve being in its normally open position. During servicing operations with the box cover open, a shut-off valve on the supply tank is closed to arrest the flow of $GN_2$ into the box. The fan and heater are cycled on and off as a result of the sensor controlled temperature controller closing as the box temperature is elevated to approximate room temperature and opening as the temperature drops below the programmed temperature. Closing of the temperature controller activates the heater relay to open the circuit to the fan and heater. It has been determined that approximately 6 hours are required to raise the sub-zero temperature of the rivets, hoppers and box components to ambient or room temperature via the fan and heater. In comparison, approximately 40 hours are required to produce the same results by natural convection.

An object of the present invention is to provide a moisture free refrigeration system for an automatic riveting machine in which the refrigerant is further utilized to evacuate air from the refrigerated enclosure.

Another object of this invention is to provide a refrigeration system for automatic riveting machines embodying automatic means to duct purge gas into the refrigerator enclosure during the "off" cycle of the refrigeration system.

Still another object of this invention is to provide a refrigeration system for an automatic riveting machine embodying heater means to increase the temperature within the refrigerator enclosure to a level comfortable to the workman performing service operations therein in a minimum of time and under moisture free conditions.

Yet another object of this invention is to provide a refrigeration system for an automatic riveting machine adapted to inhibit moisture formation within the refrigerator enclosure at all times regardless of a power failure in the electrical circuitry associated therewith.

A further object of the present invention resides in the noval relief valve arrangement to render the refrigerant system fail-safe under all operating and non-operating conditions.

Another object of the invention is to provide a refrigeration system for an automatic riveting machine utilizing a liquid refrigerant to maintain sub-zero temperature within the refrigerator enclosure, and further utilizing said liquid refrigerant in its gaseous state to inhibit moisture formation within said enclosure.

Yet another object of the invention lies in the novel construction of a refrigerator enclosure for an automatic riveting machine whereby the hoppers enclosed thereby may be supplied with a quantity of rivets under moisture free conditions while the machine is in operation or idle.

Still another object of the present invention is the provision for transporting individually dispensed rivets from the refrigerated hoppers of an automatic riveting machine to the heading mechanism thereof while in frozen and moisture free condition.

Other objects and advantages will become apparent to those skilled in the art from the following specification.

BRIEF DESCRIPTIONN OF THE DRAWINGS

FIG. 1 is a side elevational view of a usual automatic riveting machine embodying the refrigerator apparatus of the present invention shown mounted on the upper frame portion thereof.

FIG. 2 is an enlarged perspective view of the refrigerator box with portions broken away and in section to facilitate the illustration of the interior details, and FIG. 3 is a schematic view of the refrigeration and purge conduit systems of the present invention showing the electrical components and circuitry for automatic control thereof and further showing the electrical components and circuitry for the automatic control of a fan and heater.

DETAILED DESCRIPTION OF THE INVENTION

Figure 1:
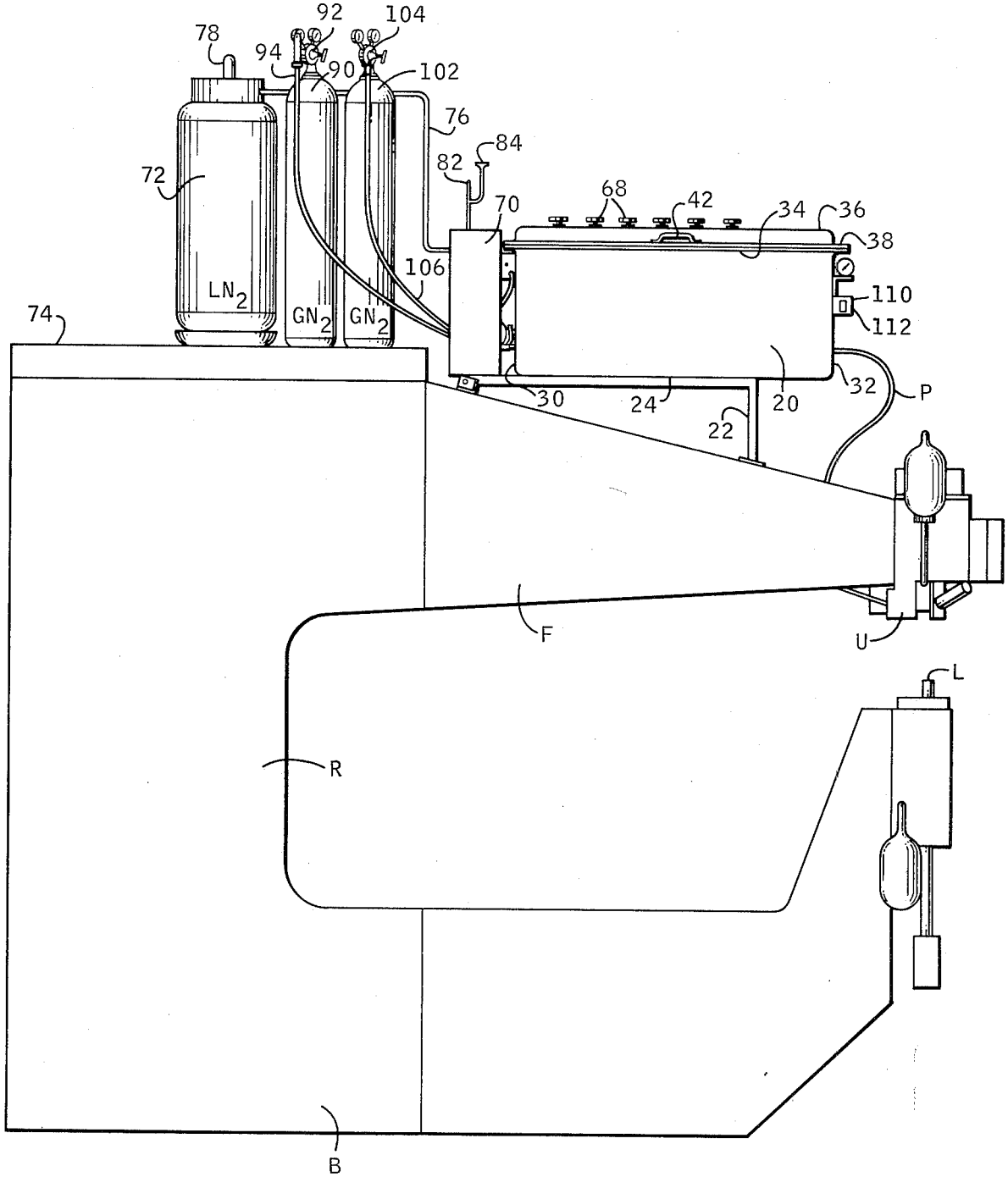
Figure 2:
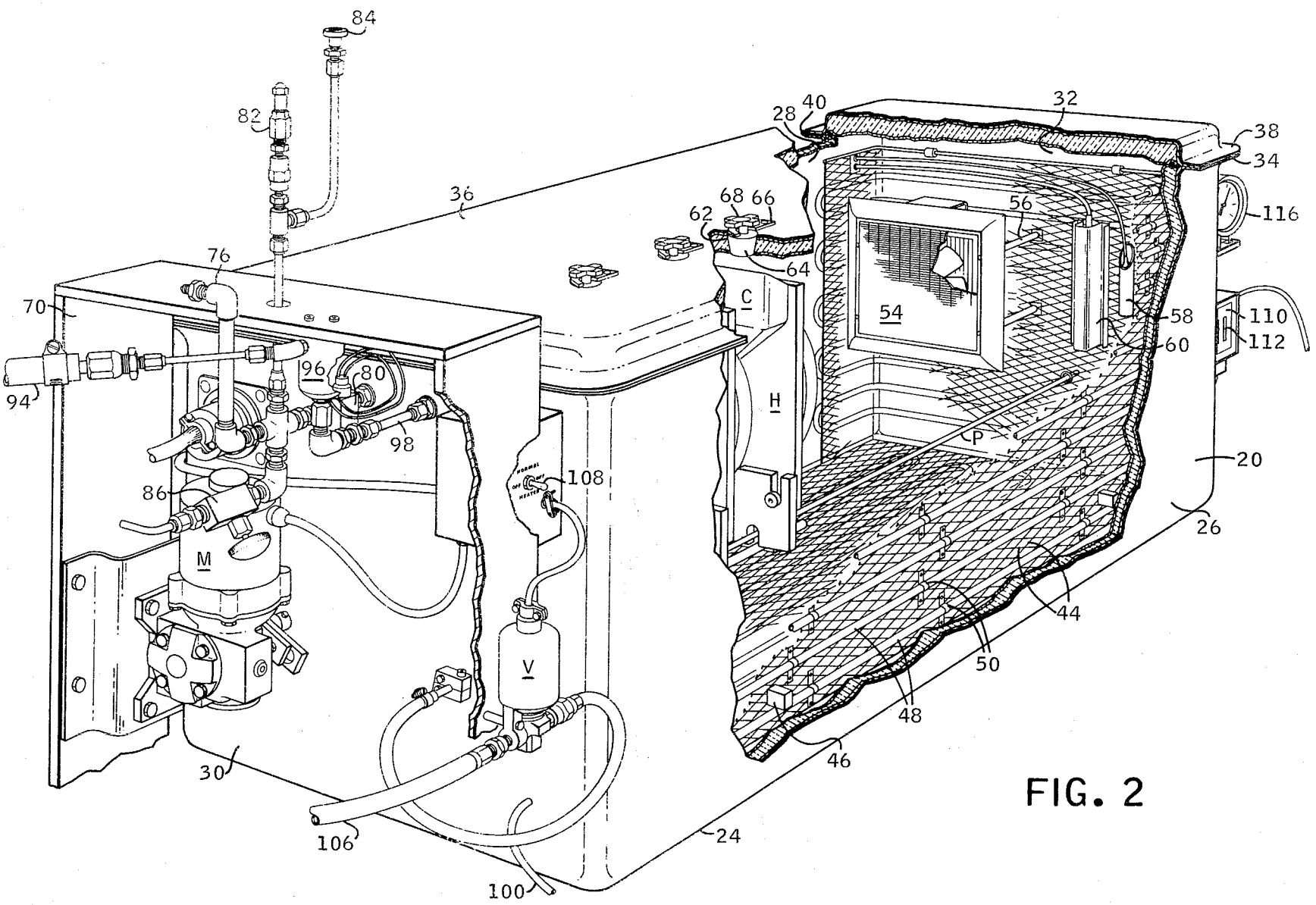

Referring to FIG. 1, there is shown a side elevational view of an automatic riveting machine generally designated R. Riveting machine R may be any one of several commercial types presently available such as an "Erco Plant" machine manufactured by the Nuclear Products-Erco Division of the ACF Industries Incorporated located in Riverdale, Maryland. The frame of riveting machine R is substantially C-shaped having a base member B in which a lower head assembly L is mounted in vertical axial alignment with an upper head assembly U mounted in the cantilevered upper frame F of the machine R.

For convenience and space conservation purposes the refrigeration apparatus of the present invention is shown mounted on the upper surface of the cantilevered upper frame F of riveting machine R. It should be noted however that the location of the refrigeration apparatus relative to the riveting machine R is not critical to the operation of the invention, since it is within the scope of the invention to locate it in any convenient area preferably within close proximity to the riveting machine R.

An insulated double walled refrigerator box 20 is secured to a frame 22 which is in turn secured to upper frame F of riveting machine R. Box 20 comprises an insulated double walled bottom 24 integral with insulated double walled sides 26 and 28, and insulated double walled ends 30 and 32. A continuous flange 34 flares outwardly from the upper extremity of walls 26, 28, 30 and 32. An insulated double walled cover 36 having a peripheral flange 38 overlying flange 34 of box 20 is hinged to flange 34 by a suitable hinge 40. Cover 36 provides access means to the interior of box 20 for servicing purposes as will be hereinafter more fully described. A handle 42 secured to cover 36 serves as a convenient means for hinging the cover from closed to open position to gain access to the interior of box 20. If desired, handle 42 may incorporate a latch or lock to secure cover 36 in closed position. Thus when cover 36 is closed, box 20 with cover 36 forms a double walled insulated enclosure for housing the usual rivet hoppers normally associated with automatic riveting machines of the type hereinbefore described. Any suitable insulating material such as polyurethane foam may be sandwiched intermediate the double walls of box 20 and cover 36 to effectively insulate the enclosure.

A coil support member 44 parallelly spaced from bottom 24 and side and end walls 26, 28, 30 and 32 is preferably fabricated from screen or expanded metal material to facilitate circulation of gas in and around the refrigeration coils. A plurality of spacers 46 and fasteners such as bolts (not shown) secure member 44 to the box 20. A refrigeration coil 48 of serpentine configuration mounts on member 44 in the area between member 44 and the bottom, sides, and end walls 24–32 respectively, of box 20. Coil 48 is secured to member 44 at randomly spaced locations by a plurality of clips 50 looped over the tubing of the coil 48 and secured at opposite ends to member 44 by suitable fasteners as rivets, or bolts and nuts. Coil 48 enters box 20 through end wall 30 and terminates in an upwardly extending open end 52 (FIG. 3) after passing along the end walls, side walls, and bottom thereof. A resistance type heater and circulating fan assembly 54 mounts inside box 20 by means of spacer bolts 56 extending through member 44 into end wall 32. Heat and cold temperature sensors 58 and 60, respectively, are secured to the member 44 in a convenient location within box 20 such as adjacent the heater assembly 54 on end wall 32.

The automatic riveting machine R of the type hereinbefore described, includes a plurality of rivet hoppers each containing a supply of rivets of a particular size or length. The function of the hoppers is to dispense the rivets contained in the rotatable magazine thereof individually for delivery and insertion into the machine drilled hole of a workpiece to be riveted. In order to adapt the riveting machine R for use with 2024S or ice box rivets, the hoppers, generally designated H, are enclosed within the box 20. Integral with hoppers H are chutes C adapted to funnel rivets into the magazines thereof. Cover 36 of box 20 is provided with a plurality of tapered openings 62 aligned with the chutes C of the hoppers H for depositing rivets into the magazines of the hoppers H. Tapered plugs or inserts 64 are installed in the openings 62 after the hoppers H have been provided with a supply of rivets. Suitable latches 66 pivotally secured to the cover 36 engage the plugs 64 below the handles 68 thereof to prevent accidental displacement of the plugs or displacement thereof as a result of pressurization occurring within the box 20. The magazines (not shown) of hoppers H are rotated through a motor and gear box drive M of the riveting machine R. The motor and gear box drive are preferably mounted on a box frame 70 adjacent end wall 30 of box 20, or if desired, may be mounted directly onto the external surface of end wall 30 outside of box 20. Thus heat generated by the motor M is not conducted into the refrigerated interior of the box 20. Moreover, the efficiency of the motor M is not adversely affected as a result of the motor being exposed to the sub-zero temperature of the box 20.

The refrigerant employed in refrigerating box 20 is preferably liquid nitrogen ($LN_2$) contained in the tank 72 resting on a platform 74 of the upper frame of the riveting machine R. A conduit 76 connected to shut-off valve 78 of tank 72 conducts $LN_2$ to a normally closed, solenoid actuated valve 80. When in open position, valve 80 provides direct communication between the $LN_2$ tank 72 and the refrigerator coils 48 which coils are connected to the discharge port of valve 80. Relief valves 82 and 84 communicating with conduit 76 provide automatic venting means for the $LN_2$ in the event that valves 78, 80 and 86 are all closed. Relief valve 82 is pre-set to open automatically when expansion of the $LN_2$ exceeds a safe pressure. The system is rendered fail-safe by the rupture-disc type relief valve 84 which is designed to rupture at a slightly higher pressure than the pre-set opening pressure of the spring-biased valve 82. A drain valve 86 communicates with the conduit 76 to provide means for bleeding air or $LN_2$ from the conduit during start-up and/or shutdown of the refrigeration system. A usual relief valve 88 connects to the $LN_2$ tank 72 to provide venting means for the $LN_2$ upon expansion thereof as a result of exposure to room temperatures.

In cooperation with, and in addition to the $LN_2$ system, box 20 is further provided with a gaseous nitrogen ($GN_2$) system to maintain a dry atmosphere within the box. The $GN_2$ system is further utilized to purge air from box 20 prior to refrigerating and to prevent air from entering during servicing operations, etc. as will be more fully described hereinafter.

The $GN_2$ system comprises a pressurized $GN_2$ storage tank 90 having a usual shut-off valve and flow regulator and gauge device 92 connected therewith. A conduit 94 connects valve 92 to a solenoid actuated, normally open valve 96. Valve 96 communicates with a conduit 98 which projects into box 20 through end wall 30 thereof. A vent 100 opening to atmosphere, is preferably located adjacent the bottom 24 of box 20 in the end wall 30 thereof to provide means for evacuating air during purging in addition to serving as a discharge port for the flow of $GN_2$ to atmosphere.

Rivets contained in the hoppers H of the rivet machine R are transported to the machine's rivet sets through a conduit P. Gaseous nitrogen is released into conduit P by a solenoid actuated, normally closed valve V similar to the valve 80 of the hereinbefore described $LN_2$ system. With the exception of $GN_2$ being substituted for pressurized air, the rivet eject and transport system functions in the usual manner common to automatic riveting machines of the type previously described. A $GN_2$ storage tank 102 having a shut-off valve 104 connected therewith, supplies $GN_2$ to the valve V through a conduit 106. The discharge port of valve V connects to the conduit P which passes through end wall 30 of box 20 where it engages the rivet dispensing mechanism (not shown) of each of the individual hoppers H. As previously discussed, the hoppers H together with their attendant mechanism including the conduit P and valve V, are components of the automatic riveting machine per se and accordingly constitute no part of the present invention.

Figure 3:
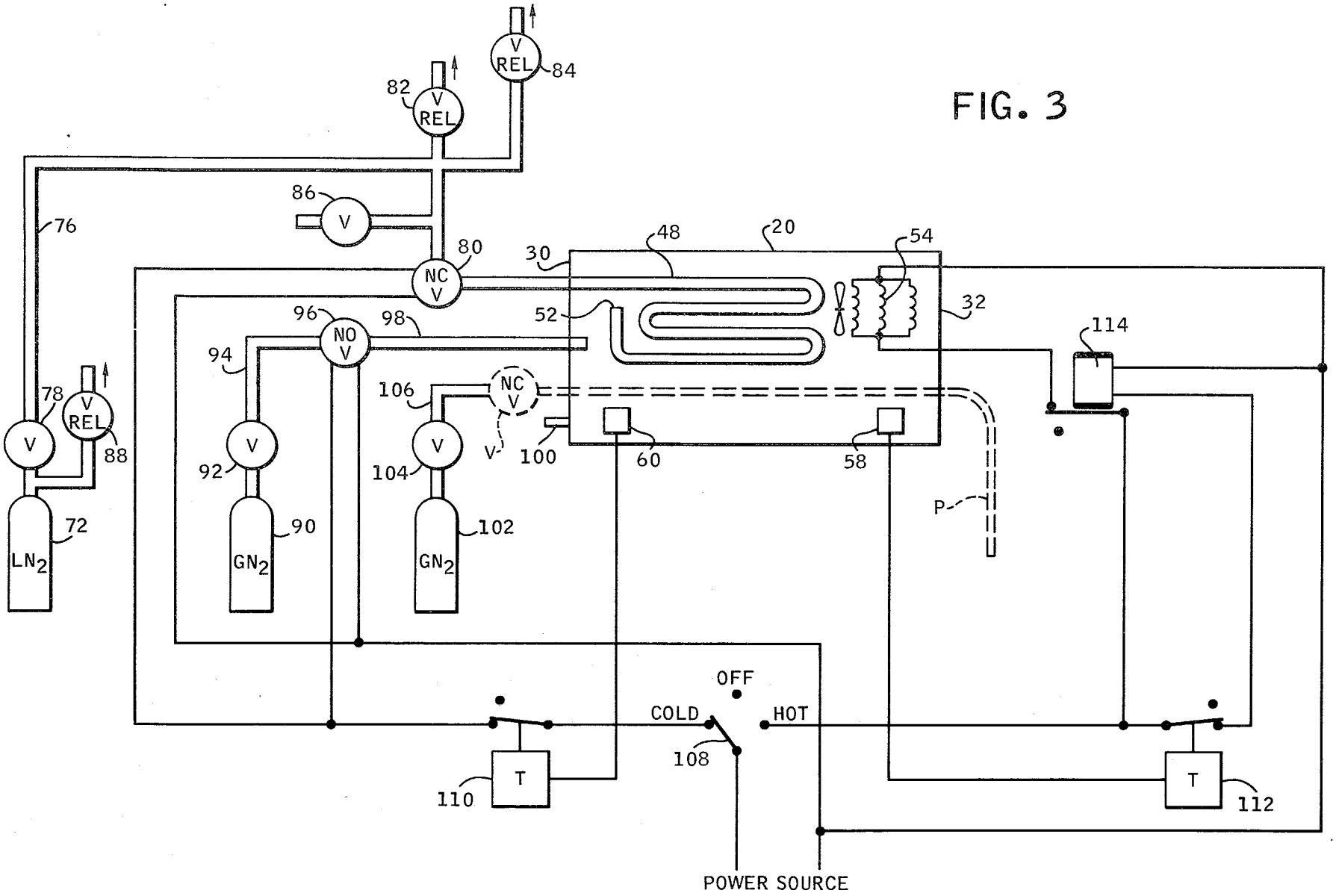

In preparation for activating the refrigeration system, it is first desirable to bleed trapped air out of conduit 76 between the $LN_2$ tank valve 78 and the normally closed valve 80. This is accomplished by opening drain valve 86 and thereafter opening the $LN_2$ tank valve 78 to permit $LN_2$ to flow through conduit 76 and discharge to atmosphere through drain valve 86. Immediately following purging of conduit 76, a three-position switch 108 in circuit with a convenient power source is switched to the "cold" or refrigeration position. When switch 108 is in the cold position as illustrated in FIG. 3, normally closed valve 80 is maintained in open position and normally open valve 96 is maintained in closed position by energization of their respective solenoids. In its open position, valve 80 provides direct communication via conduit 76 for the passage of $LN_2$ from supply tank 72 into refrigeration coil 48. The $LN_2$ flows through the serpentine refrigeration coils 48 discharging into box 20 from the open end 52 of coils 48 in a dry or gaseous state. Flow of the $LN_2$ continues with the gaseous nitrogen venting to atmosphere through the vent 100 in the end wall 30 of box 20. Upon cooling of the box to the temperature desired (approximately −5° to −10°F., as may be indicated on the dial thermometer 116), sensor 60 in box 20 activates a normally closed temperature controller 110 interrupting the refrigeration circuit and permitting valves 80 and 96 to return to their normally closed and normally open positions, respectively. Thus the flow of $LN_2$ is discontinued concurrently with the introduction of gaseous nitrogen from the supply tank 90 through valve 92, conduit 94, valve 96, and conduit 98 into box 20. Nitrogen is preferred over other gases for maintaining a dry atmosphere within the refrigerator box since it is nonexplosive and may be discharged into the surrounding area of the riveting machine without danger to operating personnel. If desired, carbon dioxide may be substituted for nitrogen by extending the vent line 100 a distance sufficient to discharge the $CO_2$ outside of the building in which the rivet machine R is housed.

Switch 108 is provided with an "off" position to inactivate the refrigeration system for extended periods of time. This position is used primarily when the rivets to be dispensed are other than the "ice box" type as hereinbefore described. During such "off" time, valves 78 and 92 on the $LN_2$ and $GN_2$ tanks 72 and 90, respectively, are closed to converve the refrigerant and purge gas supply. The solenoid of valve 80 is de-energized causing the valve to return to its normally closed position. Liquid nitrogen remaining in the conduit 76 between closed valves 78 and 80 is drained therefrom via drain valve 86. As a safety means, conduit 76 is provided with fail-safe relief valves 82 and 84 communicating therewith. As previously described, valves 82 and 84 function to release $LN_2$ automatically as a result of an excessive pressure rise in the conduit 76.

The third position of the three position switch 108 serves to activate the heating system of box 20 to increase the temperature thereof to a level commensurate with the comfort of the workman performing service operations, such as changing rivets, or other routine maintenance. Switch 108 is moved to the "hot" position to activate the heating system. In the heating mode, a normally closed temperature controller 112 interrupts the circuit of a normally closed heater relay 114. Without power, heater relay 114 remains in closed position whereby the circuit to the fan and heater 54 is rendered operational. Heater and fan 54 cycle intermittently until such time as the temperature of the rivets, hoppers, and other elements contained within box 20 stabilizes at the temperature programmed into controller 112. During the heating cycle with cover 36 closed, valve 92 of the $GN_2$ tank 90 remains open to provide a continuous flow of $GN_2$ into the box 20 to inhibit the formation of frost on the rivets, hoppers, and their associated mechanism.

Many modifications and variations of the present invention are possible in the light of the above teachings. It is therefore to be understood that within the scope of the appended claims the invention may be practiced otherwise than as specifically described.

What is claimed is:

1. A refrigeration apparatus for an automatic riveting machine comprising:

at least one hopper adapted to store and dispense rivets;

an insulated enclosure in which said hoppers are mounted;

refrigeration coils mounted in said enclosure;

said coils connected to a supply source of a vaporizable liquid refrigerant;

said coils having an opening for discharging said refrigerant into said enclosure in its dry gaseous state;

a vent in said enclosure to vent said gaseous refrigerant to the exterior thereof;

means to conduct a moisture inhibiting gas into said enclosure;

a normally closed valve between said source of vaporizable liquid refrigerant and said enclosure;

a normally open valve between the source of moisture inhibiting gas and said enclosure;

means to open and close said normally closed valve concurrently with the closing and opening, respectively, of said normally open valve; and a heater positioned within said enclosure for rapidly increasing the temperature of said hoppers for servicing thereof;

said normally closed valve being closed and said normally open valve being open during operation of said heater.

2. The refrigeration apparatus of claim 1 wherein:

rivets are ejected and transported from said enclosure by a pressurized moisture inhibiting gas.

3. A refrigeration apparatus for an automatic riveting machine comprising:

at least one hopper adapted to store and dispense rivets;

an insulated enclosure in which said hoppers are mounted;

refrigeration coils mounted in said enclosure;

said coils connected to a supply source of a vaporizable liquid refrigerant;

said coils having an opening for discharging said refrigerant into said enclosure in its dry gaseous state;

a heater mounted with said enclosure adapted to rapidly increase the temperature of said hoppers for servicing thereof; and means to eject and transport rivets from said enclosure utilizing a pressurized moisture inhibiting gas.

* * * * *